United States Patent [19]

Inoue

[11] Patent Number: 4,628,229

[45] Date of Patent: Dec. 9, 1986

[54] FLASHLIGHT EMISSION APPARATUS

[75] Inventor: Akira Inoue, Hachioji, Japan

[73] Assignee: Olympus Optical Company, Ltd, Tokyo, Japan

[21] Appl. No.: 562,179

[22] Filed: Dec. 16, 1983

[30] Foreign Application Priority Data

Feb. 15, 1983 [JP] Japan ..... 58-23625
Feb. 22, 1983 [JP] Japan ..... 58-28174

[51] Int. Cl.[4] ..... H05B 37/00; H05B 39/00; H05B 41/14

[52] U.S. Cl. ..... 315/241 P; 315/120; 315/129; 354/145.1; 354/147

[58] Field of Search ..... 315/241 P, 120, 129; 354/145.1, 147, 127.11, 127.12

[56] References Cited

U.S. PATENT DOCUMENTS 4,130,780 12/1978 Ban et al. ..... 315/241 P
4,163,924 8/1979 Hasegawa et al. ..... 315/241 P
4,273,432 6/1981 Matsuda et al. ..... 354/145.1
4,374,345 2/1983 Takayama ..... 315/241 P
4,426,144 1/1984 Kawazoe ..... 354/145.1
4,430,602 2/1984 Ohmori ..... 315/241 P
4,441,774 4/1984 Kazami et al. ..... 315/241 P
4,464,609 8/1984 Nakamura et al. ..... 315/241 P
4,479,076 10/1984 Yamaoka et al. ..... 315/241 P

FOREIGN PATENT DOCUMENTS 2743913 4/1978 Fed. Rep. of Germany ... 315/241 P
48-23744 7/1973 Japan .

*Primary Examiner*—Saxfield Chatmon
*Attorney, Agent, or Firm*—Louis Weinstein

[57] ABSTRACT

A flashlight emission apparatus is provided which inhibits the emission of flashlight from a flash discharge tube before a voltage to which a main discharge capacitor is charged reaches a proper voltage level for emission. This occurs in response to an output from a detector that detects the voltage across the main capacitor. The apparatus provides an indication that the main capacitor is being charged as long as the converter is in operation to provide a booster action, and terminates the indication and ceases the operation of the converter when the voltage across the main capacitor reaches a proper voltage level for emission.

15 Claims, 9 Drawing Figures

FLASHLIGHT EMISSION APPARATUS

BACKGROUND OF THE INVENTION

The invention relates to a flashlight emission apparatus, and more particularly, to such apparatus which automatically controls the power supply to a main discharge capacitor.

As is well recognized, a conventional flashlight emission apparatus which is used for flash photography includes a main discharge capacitor charged to a high voltage, the discharge of which triggers a flash discharge tube to emit light. The emission of flashlight from the tube is enabled when the capacitor is charged to a level which exceeds a discharge initiate voltage of the tube.

Also, a conventional flashlight emission apparatus includes a neon tube which becomes illuminated to indicate the completion of a charging operation whenever the main capacitor has been charged to a level which is sufficient to enable the discharge tube to produce a given amount of emission.

FIG. 1 is a circuit diagram of an electrical circuit which may be used in a conventional flashlight emission apparatus. The apparatus essentially comprises a battery E1 of a low voltage; a DC-DC converter 1 including a feedback transistor Tr1, an oscillating transistor Tr2, a step-up transformer T1 and rectifier diode D1; a main discharge capacitor C2; a neon tube Ne1 which indicates the completion of a charging operation; a trigger circuit 2 including synchro-contacts SW2, a trigger capacitor C3 and a trigger transformer T2; and a flash discharge tube Xe1.

The positive terminal of the battery E1 is connected to one end of a primary coil of the transformer T1 while its negative terminal is connected to the emitter of the oscillating transistor Tr2 of an NPN type through a main switch SW1. The collector of this transistor is connected to the other end of the primary coil of the transformer T1, and its base is connected through a resistor R2 to the collector of the feedback transistor Tr1 of a PNP type. The transistor Tr1 has its emitter connected to the positive terminal of the battery E1 and its base connected to one end of a secondary coil of the transformer T1 and also connected to the junction between the resistor R1 and capacitor C1. The other end of the resistor R1 is connected to the negative terminal of the battery E1 through the switch SW1 while the other end of the capacitor C1 is connected to the positive terminal of the battery E1. The other end of the secondary coil of the transformer T1 is connected to the anode of the diode D1, the cathode of which is connected through a resistor R3 to one end of a neon tube Ne1 and also connected to one end of a main discharge capacitor C2. The other end of the tube Ne1 is connected to a common bus or ground line $l_0$ which is connected to the negative terminal of the battery E1 through the main switch SW1, as is the other end of the main capacitor C2.

The flash discharge tube Xe1 and the trigger circuit 2 which triggers the tube Xe1 are connected in shunt with the main capacitor C2. Specifically, a series combination of a resistor R4 and synchro-contacts SW2 is connected in shunt with the capacitor C2, with the junction therebetween being connected through the trigger capacitor C3 to one end of a primary coil of the trigger transformer T2, the other end of which is connected to the common bus $l_0$ and also connected to one end of a secondary coil of the transformer T2. The other end of the secondary coil is connected to a trigger electrode of the discharge tube Xe1.

In the described arrangement, when the main switch SW1 is closed, the transistors Tr1 and Tr2 in the DC-DC converter 1 are repeatedly turned on and off to provide an oscillating or intermittent current flow through the primary coil of the transformer T1, with result that a high voltage is induced across the secondary coil thereof and is applied to the capacitor C2 through the diode D1. The voltage across the main capacitor C2 increases gradually in a manner graphically illustrated in FIG. 2, and when such voltage reaches a discharge initiate voltage $V_{MIN}$ of the discharge tube Xe1, the emission of flashlight from the tube Xe1 is enabled even though the neon tube Ne1 has not yet been illuminated. As the charging operation continues and the voltage across the main capacitor C2 reaches a voltage level $V_{PRO}$ representing a proper level for emission of flashlight from the discharge tube Xe1, the neon tube Ne1 initiates its discharge, thus indicating the completion of the charging operation of the main capacitor C2. If the charging operation is further continued, the voltage across the main capacitor C2 asymptotically approaches a maximum voltage $V_{MAX}$ which is determined by the turns ratio between the primary and the secondary coil of the transformer T1.

However, in a conventional flashlight emission apparatus as described above, the emission of flashlight from the discharge tube Xe1 is enabled if the voltage across the main capacitor C2 exceeds the initiate voltage $V_{MIN}$ at $t_1$ even before it reaches the proper voltage $V_{PRO}$ at $t_2$. Accordingly, if the discharge tube Xe1 should be triggered at time between $t_1$ and $t_2$, it will discharge to emit flashlight of an amount which is insufficient to provide a proper exposure. This leads to a difficulty that a user may be unaware of the resulting underexposure, thus missing the chance to take another picture with a proper amount of exposure.

Also in a conventional flashlight emission apparatus as described above, as long as the main switch SW1 remains closed, the converter 1 continues its booster operation even after the voltage across the main capacitor C2 has reached the proper voltage level $V_{PRO}$ to cause the neon tube Ne1 to continue its discharge, thus resulting in a wasteful dissipation of the capacity of the battery E1. If a user inadvertently forgets to turn the main switch SW1 off, the battery E1 may be exhausted as a result of the discharge of the neon tube Ne1, making the flashlight emission apparatus useless when required.

SUMMARY OF THE INVENTION

It is an object of the invention to provide a flashlight emission apparatus including means which inhibits the emission of flashlight from a flash discharge tube in response to an output from a detector which detects a voltage across a main discharge capacitor before such voltage reaches a proper voltage level.

It is another object of the invention to provide a flashlight emission apparatus including means which indicates that a main discharge capacitor is being charged as long as a converter effecting a booster operation for a supply voltage is in operation and also including means which interrupts the operation of the converter whenever the voltage across the main capacitor has reached a proper voltage level.

In accordance with the invention, the emission of flashlight from a flash discharge tube is inhibited before a voltage across a main discharge capacitor reaches a proper voltage level. Accordingly, any attempt to release the shutter of a camera before the proper voltage level is reached cannot cause the flashlight emission apparatus to emit flashlight. This allows a user to recognize that he has taken a picture with an underexposure, preventing the chance to take another picture from being missed. Since the main discharge capacitor has not been discharged during the previous operation, the time required to complete the charging operation will be reduced when it is desired to take another picture.

According to another aspect of the invention, an indication is given that the main discharge capacitor is being charged as long as the converter is in operation, and such indication is disabled and the operation of the converter is interrupted upon completion of the charging operation, thus effectively preventing a wasteful dissipation of the battery after the charging operation has been completed. If a user has forgotten to turn the main switch off, the interruption of the operation of the converter subsequent to the completion of the charging operation automatically prevents the exhaustion of the battery which would cause a failure to take a flash photograph.

With the advent of batteries having a reduced size and an increased capacity, which allows a substantial reduction in the time length required to charge an electronic flash of a reduced size which may be internally housed within a camera, or which affords the possibility to provide a camera dispensing with the replacement of a battery, it will be appreciated that the apparatus of the invention which indicates that the charging operation has not been completed will be more preferred in saving the power dissipation than a conventional flashlight emission apparatus which indicates the completion of a charging operation.

DESCRIPTION OF PREFERRED EMBODIMENTS

Figure 1:
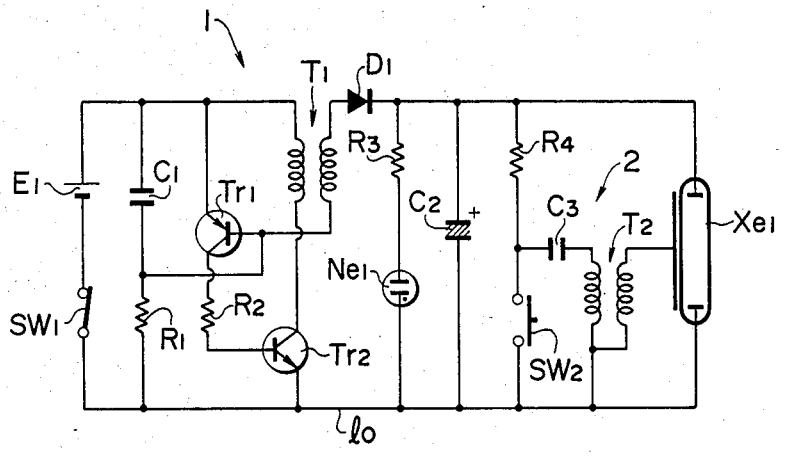
FIG. 1 (PRIOR ART)
FIG. 1 is a circuit diagram of one exemplary electrical circuit of a conventional flashlight emission apparatus.
Figure 2:
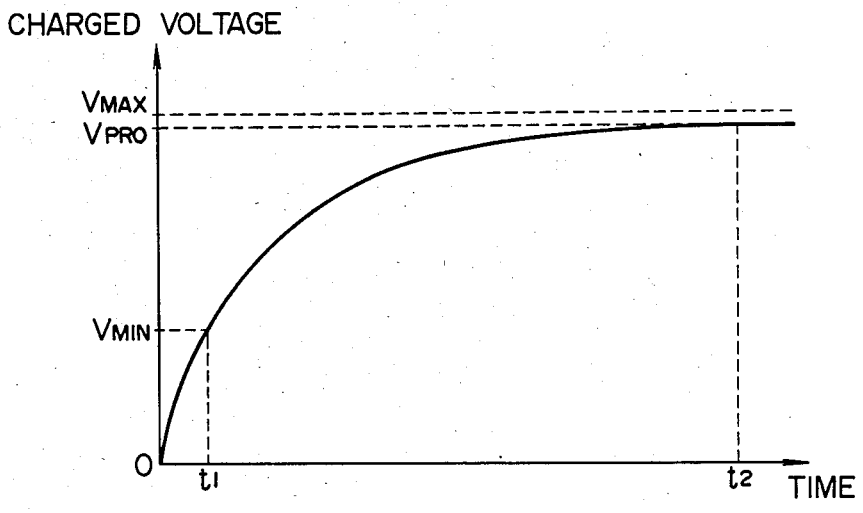
FIG. 2 (PRIOR ART)
FIG. 2 graphically illustrates a voltage across a main discharge capacitor plotted against the time which occurs in a flashlight emission apparatus as shown in FIG. 1.
Figure 3:
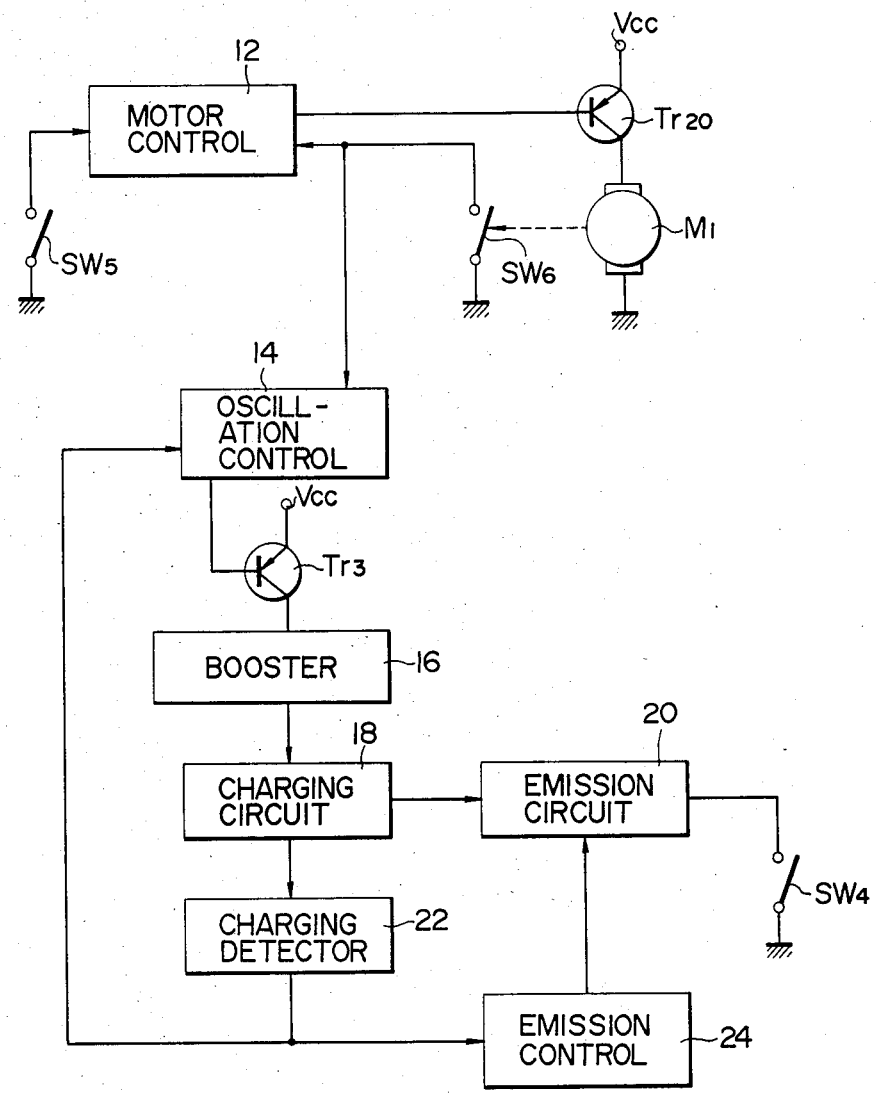
FIG. 3 is a schematic diagram and a block diagram of the electrical circuit of a flashlight emission apparatus according to one embodiment of the invention.

Referring to FIG. 3, there is shown a block diagram of a flashlight emission apparatus according to one embodiment of the invention. It is to be understood that a flashlight emission apparatus of the present embodiment is adapted to be disposed within, as an integral part of, a camera of the type in which a film is wound up by means of an electric motor M1. It will be noted that one end of the motor M1 is connected to the collector of a control transistor Tr20 of PNP type, while the other end of the motor is connected to the ground. Operating voltage Vcc is applied to the emitter of the transistor Tr20, the base of which is connected to a motor control circuit 12. A winding initiate switch SW5 has its one end connected to the ground and its other end connected to the motor control circuit 12. The switch SW5 is adapted to be closed upon completion of a shutter operation, thus feeding a winding initiate signal to the motor control circuit 12. A winding complete switch SW6 has its one end connected to the ground and its other end connected to the motor control circuit 12 and also to an oscillation control circuit 14. The switch SW6 is closed upon completion of a film winding operation in connection with the operation of the motor M1, thus feeding a winding complete signal to the circuits 12 and 14.

The oscillation control circuit 14 has an output which is connected to the base of a control transistor Tr3 of PNP type. Operating voltage Vcc is applied to the emitter of the transistor Tr3, the collector of which is connected to a booster circuit 16 which comprises a DC-DC converter of well known form for boosting a low electromotive force output from a battery to a higher voltage by utilizing an oscillating operation. The booster circuit 16 is connected to a charging circuit 18 including a main discharge capacitor and which is in turn connected to an emission circuit 20 including a flash discharge tube, and also to a charging detector circuit 22 which may comprise a neon tube, for example. The detector circuit 22 is connected to the oscillation control circuit 14 and also to an emission control circuit 24 which is in turn connected to the emission circuit 20. The function of the emission control circuit 24 is to inhibit the operation of the emission circuit 20 before the charging voltage established within the charging circuit 18 reaches a proper voltage level, and the circuit 24 operates in response to an output from the detector circuit 22. Synchro-contacts SW4 have their one end connected to the ground and other end connected to the emission circuit 20. The synchro-contacts SW4 are closed in synchronism with a full opening of the shutter, feeding a trigger signal to the emission circuit 20 which triggers a flash discharge tube. The flash discharge tube within the emission circuit 20 is triggered to emit flashlight in response to the trigger signal unless its operation is inhibited by the emission control circuit 24.

In operation, when a shutter release takes place and a shutter operation is completed, the switch SW5 is closed to feed the winding initiate signal to the motor control circuit 12, which turns the transistor Tr20 on. The motor Ml is then energized and rotates to wind up the film. When one exposed frame of the film is wound up, the switch SW6 is closed, feeding the winding complete signal to the circuits 12 and 14. In response thereto, the motor control circuit 12 turns the transistor Tr20 off, whereby the motor Ml is deenergized and comes to a stop. In response to the winding complete signal, the oscillation control circuit 14 turns the transistor Tr3 on, thus feeding the booster circuit 16 through this transistor, thus initiating a booster operation. The resulting booster output voltage is supplied to the charging circuit 18, charging the main discharge capacitor therein. When the capacitor is charged to a proper voltage level, this is detected by the detector circuit 22 which feeds the charging complete signal to the circuits 14 and 24. In response thereto, the oscillation control circuit 14 turns the transistor Tr3 off, thus interrupting the operation of the booster 16 and hence the power supply to the charging circuit 18. In response to the charging complete signal, the emission control circuit 24 releases the operation of the emission circuit 20.

It will thus be seen that the closure of the synchro-contacts SW4 cannot initiate the emission of flashlight from the flash discharge tube before the main capacitor is charged to a proper voltage level. Such emission is enabled in response to the closure of the synchro-contacts SW4 only after the capacitor has been charged to the proper voltage level. Hence, the flash discharge tube cannot emit flashlight in an insufficient amount. Since the apparatus fails to emit flashlight when a user has taken a picture with an improper exposure, he can recognize this fact. It is to be noted that the emission from the discharge tube occurs to provide a substantially given amount of light output.

Figure 4:
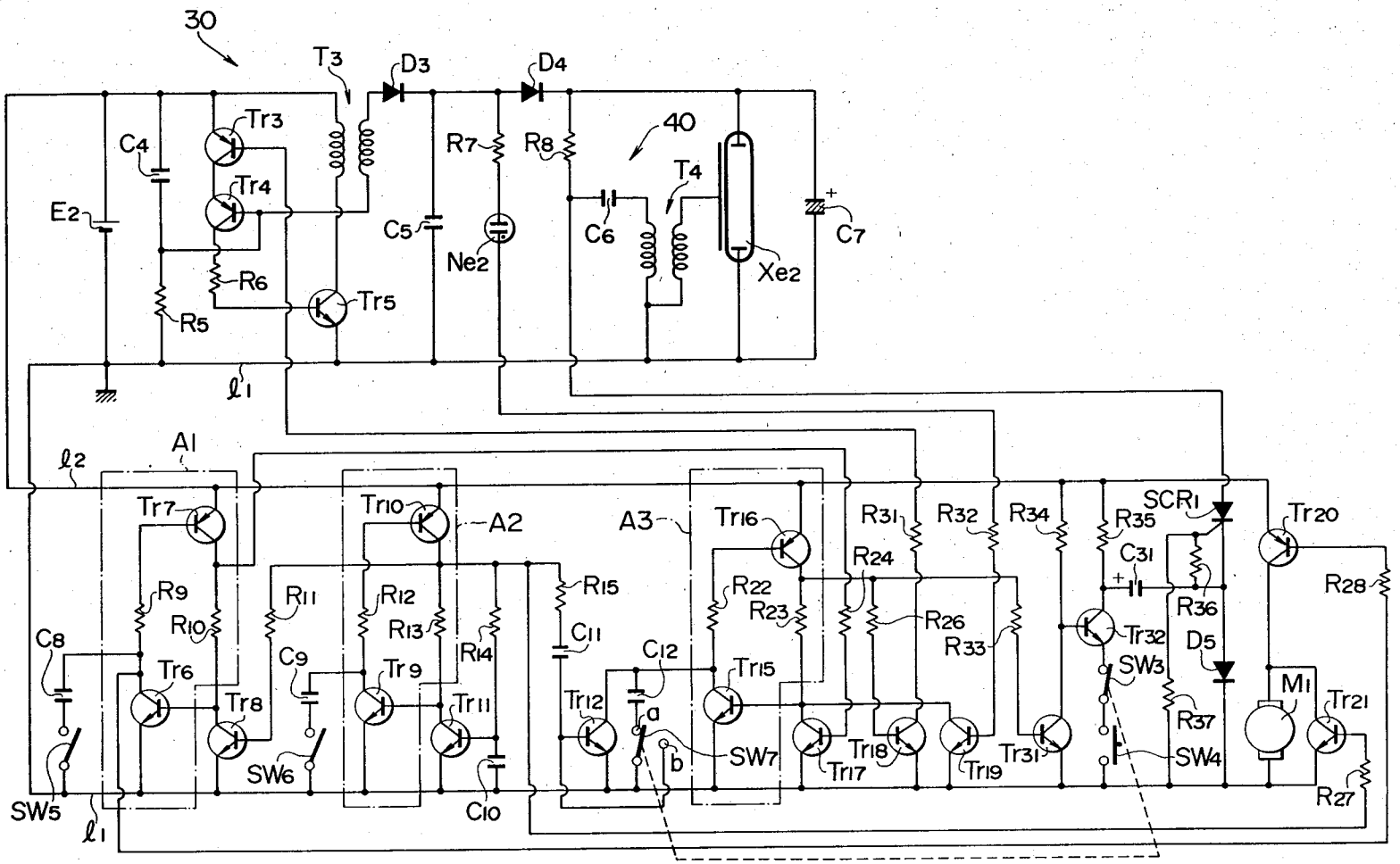
FIG. 4 is a circuit diagram showing the apparatus illustrated in FIG. 3 in more detail.

FIG. 4 is a circuit diagram showing the detail of the flashlight emission apparatus shown in block form in FIG. 3. It will be noted that a battery E2 representing a source of a low d.c. voltage has its positive terminal connected to one end of a capacitor C4, to the emitter of the control transistor Tr3 of PNP type, and to one end of the primary coil of a step-up transformer T3. The other end of the capacitor C4 is connected through a resistor R5 to a common or ground bus $l_1$ which is connected to the negative terminal of the battery E2. The collector of the transistor Tr3 is connected to the emitter of a feedback transistor Tr4 of PNP type, the collector of which is in turn connected through a resistor R6 to the base of an oscillating transistor Tr5 of NPN type. The base of the transistor Tr4 is connected to the junction between the capacitor C4 and resistor R5 and is also connected to one end of the secondary coil of the transformer T3. The collector of the transistor Tr5 is connected to the other end of the primary coil of the transformer T3 while its emitter is connected to the bus $l_1$. The other end of the secondary coil is connected to the anode of a rectifier diode D3. A combination of the components including capacitor C4, resistors R5, R6, transistors Tr3 to Tr5, transformer T3 and diode D3 forms together a DC-DC converter 30.

A capacitor C5 having a capacitance which is greatly reduced as compared with a main discharge capacitor C7, for example, on the order of 0.01 $\mu$F, is connected between the cathode of the diode D3 and the bus $l_1$. The purpose of the capacitor C5 is to cause a discharge of a neon tube Ne2 to be described later. Specifically, the cathode of the diode D3 is connected through a resistor R7 to one end of the neon tube Ne2, the other end of which is connected through a resistor 32 to the base of a transistor Tr19 to be described later. The neon tube functions to detect the voltage to which the capacitor C7 is charged.

The cathode of the diode D3 is also connected to the anode of a diode D4, functioning to prevent a reverse current flow and having its cathode connected to one end of a resistor R8, to the anode of a flash discharge tube Xe2 and to one end of the main discharge capacitor C7. The other end of the resistor R8 is connected through a series combination of a trigger thyristor SCR1 and a diode D5 to the bus $l_1$ and is also connected through a trigger capacitor C6 to one end of a primary coil of a trigger transformer T4. The other end of this primary coil is connected to the bus $l_1$ as is one end of a secondary coil of the transformer T4. The other end of the secondary coil is connected to the trigger electrode of the discharge tube Xe2. The cathode of the discharge tube Xe2 and the other end of the main capacitor C7 are connected to the bus $l_1$. A combination of the components including resistor R8, capacitor C6, trigger thyristor SCR1, diode D5, transformer T4, and a main switch SW3 and synchro-contacts SW4, both of which will be described later, forms a trigger circuit 40 associated with the flash discharge tube Xe2.

A positive or supply bus $l_2$ is connected to the positive terminal of the battery E2, and a number of circuits including a winding latch circuit A1, a brake latch circuit A2, a converter latch circuit A3 and the like are connected between the buses $l_1$ and $l_2$.

The purpose of the winding latch circuit A1 is to maintain the motor Ml in rotation during a film winding operation, and includes transistors Tr6, Tr7 and resistors R9, R10. The transistor Tr6 is of an NPN type and has its emitter connected to the bus $l_1$. The collector of the transistor Tr6 is connected to the bus $l_1$ through a series combination of a capacitor C8 and the winding initiate switch SW5, and also connected to the base of the transistor Tr20 through a resistor R28. The collector of the transistor Tr6 is additionally connected through the resistor R9 to the base of the transistor Tr7 of PNP type, the emitter of which is connected to the bus $l_2$. The collector of the transistor Tr7 is connected through a resistor R24 to the base of a transistor Tr17, to be described later, and also connected through a resistor R10 to the base of the transistor Tr6 and to the collector of a transistor Tr8. The purpose of the transistor Tr8 is to reset the winding latch circuit A1, and has its emitter connected to the bus $l_1$ while its base is connected through a resistor R11 to the collector of a transistor Tr10, to be described later.

The brake latch circuit A2 functions to maintain the motor Ml braked during a given time interval upon completion of a film winding operation, and includes transistors Tr9, Tr10 and resistors R12, R13. The transistor Tr9 is of an NPN type and has its emitter connected to the bus $l_1$ while its collector is connected to the bus l through a series combination of a capacitor C9 and the winding complete switch SW6. The collector of the transistor Tr9 is also connected through the resistor R12 to the base of the transistor Tr10, which is of a PNP type and the emitter of which is connected to the bus $l_2$. As mentioned previously, the collector of the transistor Tr10 is connected through the resistor R11 to the base of the transistor Tr8, and is also connected through a resistor R13 to the base of the transistor Tr9 and the collector of a transistor Tr11. The purpose of the transistor Tr11 is to reset the brake latch circuit A2 and has its emitter connected to the bus $l_1$ while its base is connected through a capacitor C10 to the bus $l_1$ and also connected through a resistor R14 to the collector of the transistor Tr10. The combination of the resistor R14 and the capacitor C10 forms a time constant circuit to reset the brake latch circuit A2 by turning the transistor Tr11 on after a given time delay.

Furthermore, the collector of the transistor Tr10 is connected through a resistor R27 to the base of a transistor Tr21, to be described later, and also connected to one end of a resistor R15, the other end of which is connected through a capacitor C11 to the base of an NPN transistor Tr12 and also connected to an off terminal b of a main switch SW7. The transistor Tr12 has its emitter connected to the bus $l_1$ and its collector connected to the collector of a transistor Tr15 to be described later. The main switch SW7 has a movable contact which is connected to the bus $l_1$, and also has an on terminal a which is connected to the collector of the transistor Tr12 through a capacitor C12. The combination of the capacitor C11 and resistor R15 forms a time constant circuit which maintains the transistor Tr12 on after the transistor Tr10 has been turned on, and the transistor Tr12 functions as a switching member which turns the converter latch circuit A3 on. The main switch SW7 is mechanically interlocked with the main switch SW3 mentioned previously, and has its movable contact thrown into contact with the on terminal a when the main switch SW3 is closed and has its movable contact thrown into contact with the off terminal b when the switch SW3 is opened.

The converter latch circuit A3 functions to maintain the DC-DC converter 30 operative after the transistor Tr12 is turned on until the voltage across the main discharge capacitor C7 reaches a proper voltage level for emission, and includes transistors Tr15, Tr16 and resistors R22, R23. The transistor Tr15 is of an NPN type and has its emitter connected to the bus $l_1$ while its collector is connected to the collector of the transistor Tr12 as mentioned previously, and also connected through a resistor R22 to the base of the PNP transistor Tr16. The transistor Tr16 has its emitter connected to the bus $l_2$ and its collector connected through a resistor R23 to the base of the transistor Tr15 and to the collector of a transistor Tr17. The purpose of the transistor Tr17 is to reset the converter latch circuit A3 and has its emitter connected to the bus $l_1$. The base of the transistor Tr17 is connected to the collector of the transistor Tr7 through the resistor R24, as mentioned previously. On the other hand, the base of the transistor Tr15 is connected to the collector of an NPN transistor Tr19 which functions to reset the converter latch circuit A3 in the same manner as the transistor Tr17. The transistor Tr19 has its emitter connected to the bus $l_1$ and its base connected to the other end of the neon tube Ne2 through the resistor R32, as mentioned previously. The collector of the transistor Tr16 is also connected through a resistor R26 to the base of a transistor Tr18 of an NPN type, which has its emitter connected to the bus $l_1$ and its collector connected through a resistor R31 to the base of the transistor Tr3.

The collector of the transistor Tr16 is also connected through a resistor R33 to the base of a transistor Tr31 of an NPN type, the emitter of which is connected to the bus $l_1$ and the collector of which is connected through a resistor R34 to the bus $l_2$ and also connected to the base of an NPN transistor Tr32. The transistor Tr32 has its emitter connected to the bus $l_1$ through a series combination of the main switch SW3, which is mechanically interlocked with the switch SW7, and the synchro-contacts SW4, and has its collector connected through a resistor R35 to the bus $l_2$ and also connected to one end of a trigger capacitor C31. The other end of the capacitor C31 is connected to the cathode of the trigger thyristor SCR1 and also connected through a resistor R36 to the gate thereof. The anode of the thyristor SCR1 is connected to one end of the trigger capacitor C6 while its cathode is connected to the bus $l_1$ through the forwardly poled diode D5. The gate of the thyristor SCR1 is also connected to the bus $l_1$ through a resistor R37.

The series combination of the transistor Tr20 and the motor M1 is connected between the buses $l_2$ and $l_1$, with the motor M1 being shunted by a transistor Tr21. The transistor Tr20 is of a PNP type for controlling the drive current supplied to the motor M1 and has its emitter connected to the bus $l_2$, its collector to one end of the motor Ml and its base connected through the resistor R28 to the collector of the transistor Tr6, respectively. The transistor Tr21 is of an NPN type and applies a braking effort to the motor M1 by short-circuiting it. This transistor has its collector connected to said one end of the motor M1, its emitter connected to the bus $l_1$ and its base connected through the resistor R27 to the collector of the transistor Tr10, respectively.

In operation, when the main switch SW3 is closed in order to use the flashlight emission apparatus, the trigger circuit 40 may be activated by turning the synchro-contacts SW4 on. Also, the main switch SW7 which is mechanically interlocked with the switch SW3 has its movable contact thrown into contact with the on terminal a. The transistors Tr15, Tr16 are then turned on to activate the converter latch circuit A3. As the transistor Tr16 is turned on, the transistor Tr18 is also turned on, whereby the transistor Tr3 is turned on. This allows the converter 30 to initiate its oscillating operation, providing a booster action to step up the low electromotive force from the battery E2 in order to commence charging the capacitors C5, C6 and C7.

When the converter 30 continues to operate and the voltage across the main capacitor C7 reaches a proper voltage level for emission, the neon tube Ne2 initiates a discharge of the capacitor C5. The resulting discharge current turns the transistor Tr19 on, whereby the transistors Tr15, Tr16 are turned off, thus resetting the converter latch circuit A3. This turns the transistor Tr18 off, which causes the transistor Tr3 to be turned off, ceasing the operation of the converter 30. Thus, the flashlight emission apparatus temporarily stops its operation when the capacitor C7 is charged to a proper voltage level. When once charged, a discharge of the main capacitor C7 is prevented by the presence of the diode D4. The neon tube Ne2 allows a discharge of the capacitor C5 having a reduced capacitance for a brief interval which is required for the voltage thereacross to reduce to a discharge terminate voltage, whereupon the discharge is interrupted. A reduction in the voltage across the main capacitor C7 due to its self-discharge is of a negligible magnitude for practical purposes. By experiments, it is found that when the main capacitor C7 is charged to 200 volts, it exhibits 180 volts after one hour and 170 volts after three hours.

Subsequently, when a shutter release of the camera is operated to effect a flash photography, the synchro-contacts SW4 are closed in synchronism with the full opening of the shutter. The transistor Tr32 is then turned on, and the trigger capacitor C31 which has been charged discharges through a path including the collector-emitter path of the transistor Tr32, switch SW3, contacts SW4, resistor R37 and the gate-cathode path of the thyristor SCR1, thus firing the latter. The trigger capacitor C6 which has been charged then discharges through a path including the thyristor SCR1, diode D5 and the primary coil of the trigger transformer T4, inducing a high voltage across the secondary coil thereof which is applied to the trigger electrode of the flash discharge tube Xe2 to trigger it. Thus the discharge tube Xe2 provides a discharge path for the main capacitor C7, thereby emitting flashlight. A flash photography takes place in this manner.

When a shutter operation terminates subsequent to the emission of flashlight from the discharge tube Xe2, the winding initiate switch SW5 closes in response thereto. This turns the transistors Tr6, Tr7 on, thus activating the winding latch circuit A1. As the transistor Tr6 is turned on, the transistor Tr20 is also turned on, feeding power to the motor M1. Accordingly, the motor Ml rotates to effect a film winding operation. As the transistor Tr7 is turned on, the transistor Tr17 is turned on to prevent the converter latch circuit A3 from being activated. This disables the converter 30, preventing an excessive loading upon the battery E2 during the rotation of the motor M1.

When the rotation of the motor M1 has completed winding the film by an amount corresponding to one frame and also a shutter charging operation, the winding complete switch SW6 closes to turn the transistors Tr9, Tr10 on, thus activating the brake latch circuit A2. As the transistor Tr10 is turned on, the transistor Tr8 is turned on while the transistors Tr6, Tr7 are turned off, deactivating or resetting the winding latch circuit A1. Accordingly, the transistor Tr20 is turned off as the transistor Tr6 is turned off, thus deenergizing the motor M1. At the same time, the transistor Tr10 is turned on to turn the transistor Tr21 on, which short-circuits the motor M1. This produces a braking action of the motor M1, which rapidly comes to a stop and terminates a film winding operation. On the other hand, as the transistor Tr7 is turned off, the transistor Tr17 is turned off, allowing the converter latch circuit A3 to be activated. At the same time, as the transistor Tr10 is turned on, the transistor Tr12 is turned on for a given time interval determined by the values of the resistor R15 and the capacitor C11, thus turning the transistors Tr15, Tr16 on to activate the converter latch circuit A3. As the transistor Tr16 is turned on, the transistor Tr18 is turned on, allowing the transistor Tr3 to be turned on, whereupon the converter 30 initiates its booster action. The transistor Tr11 is turned on at a given time interval determined by the values of the resistor R14 and the capacitor C10 after the brake latch circuit A2 is activated, and the transistors Tr9, Tr10 are turned off as the transistor Tr11 is turned on, whereby the brake latch circuit A2 is reset.

As mentioned previously, as the main discharge capacitor C7 continues to be charged by the operation of the converter 30 and reaches a proper voltage level for emission, the capacitor C5 discharges through the neon tube Ne2 to turn the transistor Tr19 on. This turns the transistors Tr15, Tr16 off, resetting the converter latch circuit A3 to turn the transistor Tr3 off, whereby the converter 30 ceases its booster operation. Accordingly, the flashlight emission apparatus temporarily halts its operation under the condition that the main capacitor C7 has been charged to the proper voltage level $V_{PRO}$.

It should be noted that if a shutter release operation takes place before the capacitor C7 is charged to the proper voltage level $V_{PRO}$, the flash discharge tube Xe2 does not emit flashlight. Specifically, before the capacitor C7 is charged to the proper voltage level $V_{PRO}$, the converter latch circuit A3 is maintained on in order to continue the booster operation of the converter 30, and the transistor Tr16 which is turned on causes the transistor Tr31 to be turned on. This assures the turn-off of the transistor Tr32 which breaks the discharge loop for the trigger capacitor C31 if the synchro-contacts SW4 are closed. This prevents the trigger thyristor SCR1 from being rendered conductive to complete the circuit path for the trigger capacitor C6, and hence the discharge tube Xe2 cannot emit flashlight.

As mentioned above, in the flashlight emission apparatus of the present embodiment, the discharge tube Xe2 cannot be triggered if the synchro-contacts SW4 are closed during the time the main discharge capacitor C7 is being charged. In this manner, the emission of flashlight before the charging of the main capacitor is completed is avoided. Accordingly, the failure of the emission from the discharge tube Xe2 in response to a shutter release operation allows a user to recognize instantly the need to take another picture. Since the charging of the main capacitor C7 is interrupted when it has been charged to the proper voltage level $V_{PRO}$, the emission of a constant amount of flashlight is assured.

What has been described above is the operation which occurs when the main switch SW3 is closed and the movable contact of the main switch SW7 is thrown into contact with the on terminal a. When the switch SW3 is opened and the movable contact of the switch SW7 is thrown into contact with the off terminal b, the trigger circuit 40 and the converter 30 are disabled. Specifically, when the switch SW3 is opened, the circuit path for the trigger capacitor C6 is not completed, regardless of the opening or closure of the synchro-contacts SW4, disabling the trigger circuit 40. Also as a result of the movable contact of the switch SW7 being thrown into contact with the off terminal b, the transistor Tr12 cannot be turned on, thus preventing the converter latch circuit A3 from being turned on to enable the operation of the converter 30.

Figure 5:
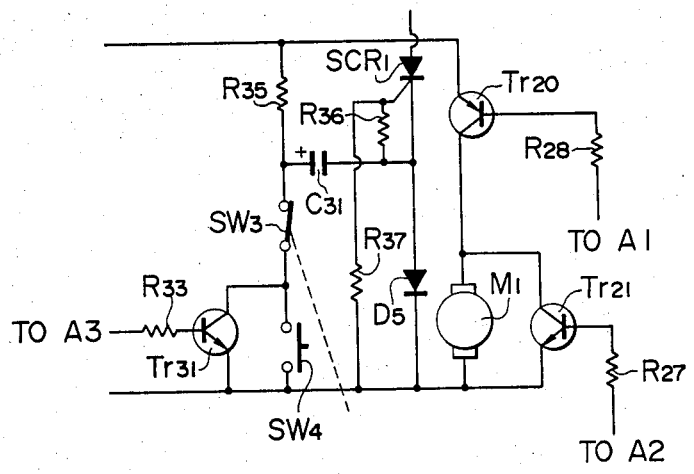
FIG. 5 is a circuit diagram of a modification of the apparatus shown in FIG. 4.

FIG. 5 is a circuit diagram of part of a modification of the apparatus shown in FIG. 4. In this modification, the transistor Tr32 and resistor R34 used in the embodiment of FIG. 4 are omitted while the collector of the transistor Tr31 is connected to the junction between the main switch SW3 and the synchro-contacts SW4.

In this modification, when the converter latch circuit A3 is activated, the transistor Tr31 is turned on, preventing the capacitor 31 from being charged. Consequently, the thyristor SCR1 cannot be rendered conductive if the synchro-contacts SW4 are closed. Consequently, there is no emission of flashlight from the discharge tube Xe2 which cannot be triggered. When the charging of the main capacitor C7 is completed and the converter latch circuit A3 is deactivated, the transistor Tr31 is turned off, allowing the trigger capacitor C31 to be charged. If the synchro-contacts SW4 are closed after the capacitor C31 has been charged, the trigger thyristor SCR1 is fired to enable the emission of flashlight, generally in a manner similar to that in the embodiment shown in FIG. 4. In other respects, the arrangement and the operation are quite similar to those described above in connection with FIG. 4.

Figure 6:
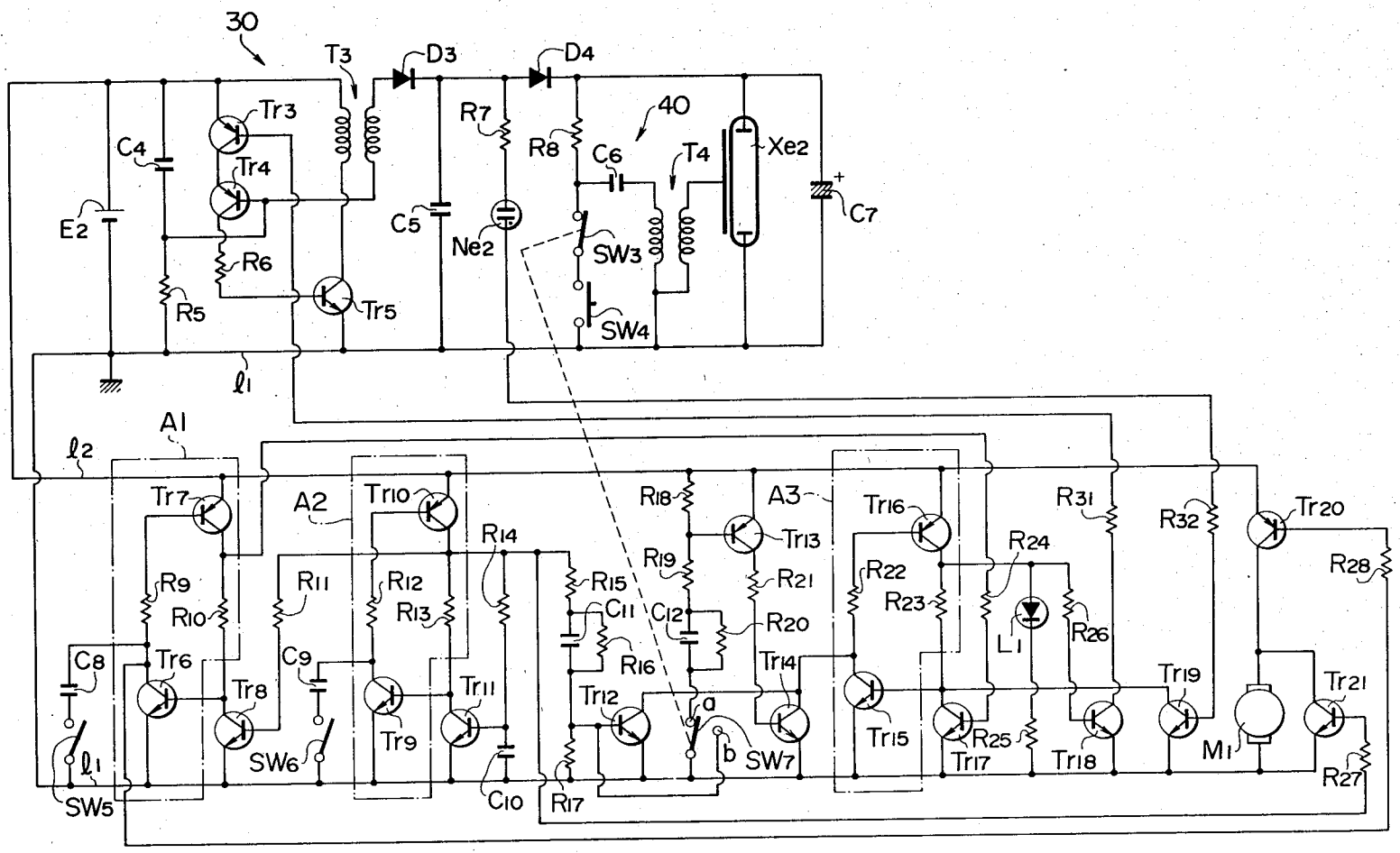
FIG. 6 is a circuit diagram of a flashlight emission apparatus according to another embodiment of the invention.

FIG. 6 is a circuit diagram of a flashlight emission apparatus according to another embodiment of the invention. It is to be noted that the flashlight emission apparatus of this embodiment is also integrally disposed within a camera which is adapted to wind up a film by means of an electric motor. In the apparatus of FIG. 6, the trigger thyristor SCR1, diode D5, capacitor C31, transistors Tr31, Tr32 and resistors R33 to R37 shown in FIG. 4 are omitted, and the series combination of the main switch SW3 and the synchro-contacts SW4 is directly connected between one end of the trigger capacitor C6 and the bus $l_1$. The main switch SW7 which is mechanically interlocked with the main switch SW3 has its on terminal a connected to the bus $l_2$ through a parallel combination of capacitor C12 and resistor R20 and resistors R19, R18. The junction between the resistors R18 and R19 is connected to the base of a PNP transistor Tr13. The combination of the capacitor C12 and the resistor R19 forms a time constant circuit which determines a time interval during which the transistor Tr13 is turned on. The transistor Tr13 has its emitter connected to the bus $l_2$ and its collector connected through a resistor R21 to the base of an NPN transistor Tr14. The transistor Tr14 functions as a switching element to activate the converter latch circuit A3, in a manner similar to the transistor Tr12 mentioned above. The transistor Tr14 has its emitter connected to the bus $l_1$ and its collector connected to the collector of the transistor Tr15. The base of the transistor Tr12 is connected to the bus $l_1$ through a resistor R17, and the capacitor C11 is shunted by a resistor R16.

The collector of the transistor Tr16 which represents the output terminal of the converter latch circuit A3 is also connected to a light emitting diode L1 which indicates that a charging operation is incomplete, the cathode of the diode L1 being connected to the bus $l_1$ through a resistor R25. It should be noted that this apparatus also includes the neon tube Ne2, but the purpose of the neon tube Ne2 is not to indicate the completion of a charging operation but is to detect the charging voltage. Although it is temporarily illuminated upon completion of the charging operation, it is immediately extinguished subsequently since the converter 30 ceases to operate. Thus it will be seen that the diode L1 is provided in the flashlight emission apparatus of the present embodiment to produce a positive indication that the charging operation is incomplete, in a manner opposite to the prior practice, in order to avoid a wasteful dissipation of a power supply subsequent to the completion of the charging operation. In other respects, the arrangement is substantially similar to that shown in FIG. 4, and hence corresponding parts are designated by like reference characters to avoid their repeated description.

In operation, the closure of the main switch SW3 enables the flash discharge tube Xe2 to be triggered in response to the turn-on of the synchro-contacts SW4, and also throws the movable contact of the main switch SW7 into contact with the on terminal a. Accordingly, there occurs a current flow through a path including the emitter-base path of the transistor Tr13, resistor R19, capacitor C12 and switch SW7, thus turning the transistor Tr13 on for a given time interval determined by the values of the resistor R19 and the capacitor C12. As the transistor Tr13 is turned on, the transistor Tr14 is turned on as are the transistors Tr15 and Tr16, thus activating the converter latch circuit A3. Hence, the converter 30 initiates its oscillating operation to commence charging the capacitors C5, C6 and C7, in a similar manner to that mentioned above in connection with FIG. 4.

Figure 7:
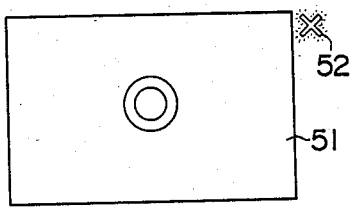
FIG. 7 is a schematic view illustrating the manner of an indication provided by the apparatus of FIG. 6 to indicate that the charging operation has not been completed.

In this embodiment, the light emitting diode L1 begins to be energized as the transistor Tr16 is turned on, illuminating an "X" mark 52 adjacent to a picture frame 51 of the camera, for example, as indicated in FIG. 7, indicating that a flash photography cannot be made because the charging operation is pending.

When the voltage across the main capacitor C7 reaches a proper voltage level $V_{PRO}$ as a result of the continued booster operation of the converter 30, the neon tube Ne2 becomes illuminated, whereby the transistor Tr19 is turned on while the transistors Tr15, Tr16 are turned off to reset the converter latch circuit A3, in a similar manner to that mentioned above in connection with FIG. 4. The converter 30 ceases to operate, and the capacitors C5, C6 and C7 cease to be charged. The diode L1 is deenergized to extinguish the display of "X" mark 52. This allows a user of the apparatus to recognize that a flash photography is now possible.

A subsequent shutter release operation causes the synchro-contacts SW4 to be closed in synchronism with the full opening of the shutter, permitting the trigger capacitor C6 to be discharged, thereby inducing a high voltage across the secondary coil of the trigger transformer T4 to trigger the discharge tube Xe2 into conduction. The main capacitor C7 discharges through the discharge tube, thus allowing the latter to emit flashlight. A flash photography thus takes place.

Upon completion of a shutter operation after the emission of flashlight from the discharge tube Xe2, the winding initiate switch SW5 is closed to perform a film winding operation and a shutter charging operation. Subsequently, the winding complete switch SW6 is closed to stop the motor Ml and allows the converter 30 to resume its operation, generally in a similar manner to that mentioned above in connection with FIG. 4.

Figure 8:
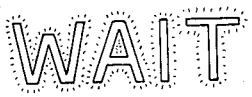
FIGS. 8 and 9 illustrate different manners of indication.
Figure 9:
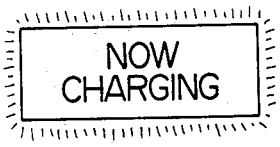

In the embodiment described above, the fact that the main capacitor C7 is being charged is indicated by the illumination of the "X" mark 52, signifying that a flash photography is now inhibited. However, it should be understood that such indication may be provided in any form desired. By way of example, FIG. 8 shows letters "WAIT" which are illuminated to instruct a user to wait for the completion of the charging operation. Alternatively, FIG. 9 shows a display panel on which are inscribed the words "now charging".

In the embodiments described above, it has been assumed that the flashlight emission apparatus is integrally disposed within a photographic camera which is adapted to wind up a film by means of an electric motor. However, it should be apparent that the apparatus of the invention can be disposed in a photographic camera which utilizes a manual film winding or may be separate from a photographic camera.

What is claimed is:

1. A flashlight emission apparatus comprising:

a converter for effecting a booster action for an output from a low voltage source;

a main discharge capacitor connected to be charged by an output from the converter;

detector means for generating an output when the main capacitor has been charged to a given voltage;

latch means which are turned on when the main discharge capacitor is charging to enable said converter and being turned off responsive to said detector means to disable said converter and prevent further charging of the main discharge capacitor when it has been charged to said given voltage;

a flash discharge tube connected to cause a discharge of the main capacitor therethrough to emit flashlight;

semiconductor means coupled between said converter and detector means and said main capacitor to permit discharge of the main capacitor only through said flash tube;

means for initiating the emission of flashlight from the flash discharge tube comprising a trigger circuit associated with the flash discharge tube for developing a trigger condition and having a trigger capacitor charged by said converter; and means responsive to an output from the detecting means for disabling the emission initiating means until the voltage across the nain capacitor reaches the given value, said disabling means comprising a switching element within the emission initiating means responsive to the on state of said latch means for normally preventing the operation of the emission initiating means and responsive to the turn off of the latch means by the detecting means output for enabling the emission initiating means.

2. A flashlight emission apparatus according to claim 1 which is disposed in a photographic camera which utilizes an automatic film winding by means of an electric motor; and means responsive to energization of the electric motor to perform a film winding operation for disabling said converter.

3. A flashlight emission apparatus according to claim 1 in which the given voltage has a level which is higher than a discharge initiate voltage of the flash discharge tube and which is sufficient to provide a proper amount of emission.

4. A flashlight emission apparatus according to claim 1 in which the detecting means comprises a neon tube.

5. A flashlight emission apparatus according to claim 1 wherein said switching element normally prevents the trigger capacitor from being discharged through the emission initiating means prior to the said main capacitor reaching said given value.

6. A flashlight emission apparatus according to claim 5 in which said switching element comprises a transistor coupled between said trigger circuit and said trigger capacitor and having a control input coupled to said latch means for rendering said transistor conductive when the voltage across the main capacitor reaches said given value.

7. A flashlight emission apparatus according to claim 1 wherein said semiconductor means is coupled between said converter and said trigger capacitor to permit the trigger capacitor to discharge only through said emission initiating means.

8. A flashlight emission apparatus comprising:

a converter for effecting a booster action for an output from a low voltage source;

a main discharge capacitor connected to be charged by an output from the converter;

means for detecting that the main capacitor has been charged to a given voltage;

a flash discharge tube connected to cause a discharge of the main capacitor therethrough to emit flashlight;

means for initiating the emission of flashlight from the flash discharge tube;

means responsive to an output from the detecting means for ceasing the operation of the converter when the voltage across the main capacitor has reached the given voltage; and means for indicating that the main capacitor is being charged as long as the converter is in operation.

9. A flashlight emission apparatus according to claim 8 which is disposed in a photographic camera which utilizes an automatic film winding by means of an electric motor; and means responsive to energization of the electric motor to perform a film winding operation for disabling said converter.

10. A flashlight emission apparatus according to claim 8 in which the given voltage has a level which is higher than a discharge initiate voltage of the flash discharge tube and which is sufficient to provide a proper amount of emission.

11. A flashlight emission apparatus according to claim 8 in which the emission initiating means comprises a trigger circuit associated with the flash discharge tube.

12. A flashlight emission apparatus according to claim 8 in which the detecting means comprises a neon tube.

13. A flashlight emission apparatus according to claim 8 in which the ceasing means comprises a switching transistor disposed within the converter.

14. A flashlight emission apparatus according to claim 8 in which the indicating means comprises a light emitting diode.

15. A flashlight emission apparatus according to claim 8, further including means responsive to one output state of the detecting means for terminating the operation of the indicating means when the voltage across the main capacitor reaches said given voltage.

* * * * *